US005626508A

United States Patent [19]

Rankin et al.

[11] Patent Number: 5,626,508

[45] Date of Patent: May 6, 1997

[54] FOCUSING NOZZLE

[75] Inventors: George J. Rankin; Samuel Wu, both of Houston, Tex.

[73] Assignee: Aqua-Dyne, Inc., Houston, Tex.

[21] Appl. No.: 425,791

[22] Filed: Apr. 20, 1995

[51] Int. Cl.[6] ..... B24C 5/04

[52] U.S. Cl. ..... 451/102; 451/75

[58] Field of Search ..... 451/75, 102, 99, 451/90, 91

[56] References Cited

U.S. PATENT DOCUMENTS

| | | | |
|---|---|---|---|
| 2,325,517 | 2/1943 | Howard | 451/102 |
| 3,906,672 | 9/1975 | Kobayashi | 451/75 |
| 4,707,952 | 11/1987 | Krasnoff | 451/75 |
| 4,937,985 | 7/1990 | Boers et al. | 451/75 |
| 5,054,249 | 10/1991 | Rankin | 451/99 |
| 5,170,946 | 12/1992 | Rankin | 239/590 |

FOREIGN PATENT DOCUMENTS

| | | | |
|---|---|---|---|
| 48907 | 7/1989 | Japan | 451/102 |

*Primary Examiner*—Bruce M. Kisliuk
*Assistant Examiner*—Andrew Weinberg
*Attorney, Agent, or Firm*—David M. O'Brian

[57] ABSTRACT

A focusing nozzle for producing and jetting a precisely focused, sustained cohesive jet of a mixture of a fluid and abrasive material, having a long coherence length and a prolonged centerline pressure for obtaining clean, precise, sharp-edged kerfs, cuts and grooves in hard substances.

9 Claims, 2 Drawing Sheets

FOCUSING NOZZLE

FIELD OF THE INVENTION

The present invention relates generally to a nozzle for producing a cohesive jet of a mixture of fluid and abrasive material. Specifically, the present invention relates to a focusing nozzle for producing and jetting a precisely focused, sustained, cohesive jet of a mixture of fluid and abrasive material, having a prolonged centerline pressure.

BACKGROUND OF THE INVENTION

Abrasive nozzles for use in combining fluid and abrasive material for producing a high pressure jet have been found to be highly effective for removing debris and applying anchor patterns on various types of surfaces. One such nozzle is taught in U.S. Pat. No. 5,054,249. Additionally, "shape jet nozzles" for producing small, high pressure, cohesive, non-circular jets of fluid are known, as taught in U.S. Pat. No. 5,170,946. However, due to the unfocused and wide spray patterns of known abrasive nozzles and the inability of using abrasive material with shape jet nozzles, no known nozzles have heretofore had any application for precision material cutting or precision material separation applications. Although not so limited, a focusing nozzle of the present invention is particularly suited for producing and jetting a precisely focused, sustained, cohesive jet of a mixture of fluid and abrasive material, having a prolonged centerline pressure, for use in producing clean, precise and sharp-edged kerfs in generally hard substances, such as for example, iron, steel, concrete, cinder blocks, brick, tile and glass. Additionally, the focusing nozzle of the present invention is designed for use with high or low pressure fluids and for use with various abrasives. The clean, precise and sharp-edged kerfs produced by the present invention are essential for precision cutting and precision material separation applications.

The ability to make clean, precise, sharp-edged kerfs, grooves or cuts in hard surfaces is of particular interest in the areas of metal working and construction. It is well known that a gear or cog may be cut from a flat sheet of steel via methods of flame cutting and/or mechanical saws, which processes use large quantities of energy and create high temperatures. Similarly, concrete, glass, tile, brick, and other forms of masonry products can be cut and separated using metallic or fibrous saw blades. The drawbacks to both of these processes, i.e. flame cutting and mechanical sawing, include the creation of large quantities of heat and friction. Additionally, both processes create the potential for adversely altering the qualities of the material being cut, especially at or near the cut edge. For instance, steel may be tempered through the process of flame cutting and sawing, increasing its brittleness and thereby losing some of its tensile qualities. Likewise, a masonry saw may adversely temper or alter the qualities of the material at or near the cut edges of the brick, concrete or tile.

This type of heat induced material alteration may not always be a desired result and may actually be quite destructive to the product which is ultimately manufactured from the material. In fact, not only is the material to be cut typically altered during exposure to heat, but a great deal of energy must be created and consumed to produce the heat necessary for flame cutting and sawing.

Heretofore, there have been no devices which produce clean, precise, sharp-edged kerfs, grooves and cuts in hard surfaces in the absence of using a flame, saw or heat producing cutting process, which may adversely affect inter alia the cut-edge. Therefore, a need exists for an apparatus to produce clean, precise, sharp-edged cuts, kerfs and grooves in hard substances such as iron, steel, concrete, tile, brick and glass for the purpose of precision cutting and precise material separation in the absence of experiencing the undesirable effects from heat. Additionally, the need exists for an apparatus to produce clean, precise, sharp-edged cuts, kerfs and grooves in hard substances such as iron, steel, concrete, tile, brick and glass using a mixture of fluid and abrasive material having a cool or moderate temperature.

Although the need for such a device has been long felt, the prior art, heretofore, has not provided such a device which meets all of the aforementioned criteria and avoids the above-referenced problems.

Additional features and advantages of the invention will be set forth in part in the description which follows, and in part will become apparent, from the description or may be learned by practice of the invention. The features and advantages of the invention may be realized by means of the combinations and steps particularly pointed out in the appended claims.

SUMMARY OF THE INVENTION

To achieve the foregoing objects, features and advantages in accordance with the purpose of the invention as embodied and broadly described herein, a focusing nozzle which produces and jets a precisely focused, sustained cohesive jet of a mixture of fluid and abrasive material, having a prolonged centerline pressure is presented to obtain clean, precise and sharp-edged kerfs, cuts and grooves in a hard surface, in the absence of producing heat and altering the characteristics of the material being cut. The clean, precise and sharp-edged kerfs, cuts and grooves are used to precisely cut and precisely separate generally hard substances. The preferred embodiment focusing nozzle preferably consists of an elongated body having a first end, a second end, a circular inlet formed at the first end of the body and a non-circular outlet formed at the second end of the body. Further, the preferred embodiment focusing nozzle includes a central, longitudinal bore retained within the elongated body, wherein the bore is disposed between and in contact with the circular inlet and the non-circular outlet. The central, longitudinal bore further includes a first circular bore portion commencing at the circular inlet and extending toward the non-circular outlet, and a second non-circular bore portion commencing at the non-circular outlet and extending toward the circular inlet. The focusing nozzle further includes an intersection within the central bore wherein the first circular bore portion intersects the non-circular bore portion. The circular bore portion generally tapers in a conical or narrowing manner, in the direction of the non-circular bore portion. The non-circular bore portion, defined by the intersection and the non-circular outlet, generally remains consistent and does not increase or decrease in size as compared to the non-circular outlet. The non-circular outlet and the non-circular bore portion may, for instance, selectively include the shape of a rectangle, a triangle, a square, a four-point star or a five-point star. The focusing nozzle generally produces a focused, cohesive, abrasive entrained jet of a mixture of fluid and particulate or abrasive material, having a long coherence length and a prolonged center line pressure wherein the focused jet produces generally clean, precise, sharp-edged kerfs, cuts and/or grooves in a hard surface which may, for instance include metal, concrete, brick and tile, in the absence of altering the quality and nature of said surface. The focused jet can selectively be of ultra high pressure or lower pressure. In particular, the focusing nozzle is designed to produce clean, precise, sharp-edged kerfs, cuts and grooves using cool or moderate temperatures in the absence of altering the characteristics of the material being cut.

BRIEF DESCRIPTION OF THE DRAWINGS

The accompanying drawings which are incorporated into and constitute a part of this specification, illustrate a preferred embodiment of the invention and together with a general description of the invention given above and the detailed description of the preferred embodiment given below serve to explain the principals of the invention.

The above general description and the following detailed description are merely illustrative of the generic invention, and additional modes, advantages and particulars will be readily suggested to those skilled in the art without departing from the spirit and scope of the invention.

DETAILED DESCRIPTION OF THE PREFERRED EMBODIMENT

Figure 1:
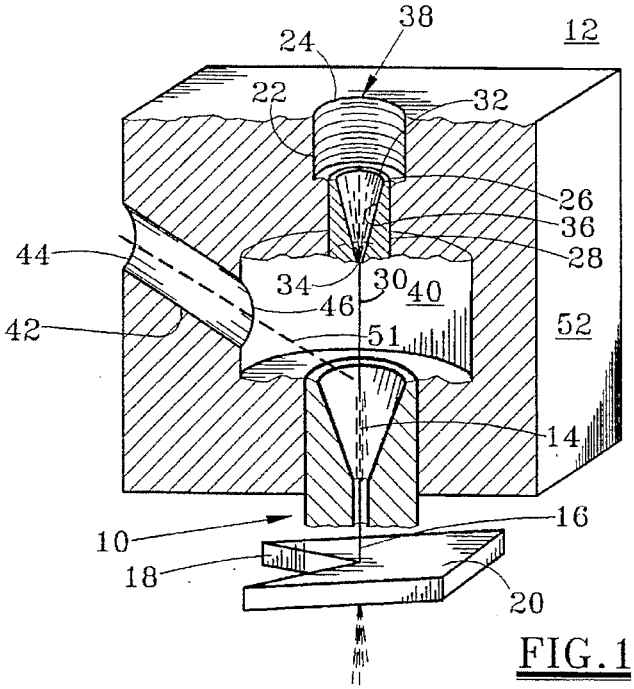
FIG. 1 is a perspective, cross-sectional block diagram of an abrasive nozzle assembly in combination with a focusing nozzle embodying the concepts of the present invention.
Figure 2:
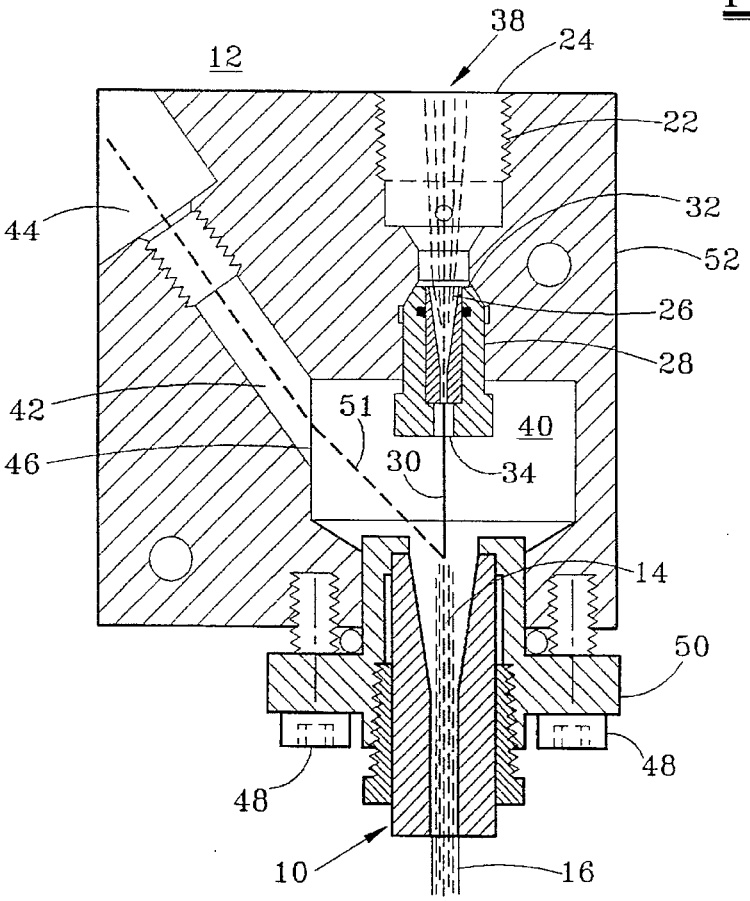
FIG. 2 is a front cross-sectional view of the abrasive nozzle assembly in combination with the focusing nozzle as illustrated in FIG. 1.

With reference to the drawings wherein like parts are designated by like numerals, FIGS. 1 and 2 illustrate a focusing nozzle 10 attached to an abrasive nozzle assembly 12. The abrasive nozzle assembly 12 serves to efficiently produce and broadcast an unfocused mixture of fluid and abrasive material 14. The focusing nozzle 10 functions to focus the mixture of fluid and abrasive material 14 being broadcast from the abrasive nozzle assembly 12 to produce a sustained, abrasive-entrained, focused jet 16, having a long cohesive length and a prolonged centerline pressure, useful in obtaining clean, precise and sharp-edged kerfs, cuts and grooves 18 in a hard surfaced material 20, to precisely cut the material 20 in the absence of altering the characteristics of the material 20. The abrasive nozzle assembly 12 may preferably include a fluidic conduit 22 defined by a fluidic inlet 24 and a fluidic outlet 26 in contact with and in fluid communication with a shaped jet nozzle 28. The shaped jet nozzle 28 functions to create a cohesive jet 30 of fluid only, unlike the present invention, which is designed to create the abrasive-entrained, focused jet 16 of the unfocused mixture of fluid and abrasive material 14. The shaped jet nozzle 28 includes a fluidic inlet 32, a non-circular fluid outlet 34 having a smaller diameter than the fluidic inlet 32, and a non-circular bore 36, in contact with and depending between the fluidic inlet 32 and the non-circular fluidic outlet 34, for conveying a fluid 38 from the fluidic conduit 22 to a vacuum chamber 40 in contact with and in fluidic communication with the non-circular fluidic outlet 34 of the shaped nozzle 28. The abrasive nozzle assembly 12 additionally includes an abrasive conduit 42 defined by an abrasive inlet 44 and an abrasive outlet 46 in angular relation to the vacuum chamber 40. The focusing nozzle 10 is preferably secured to the abrasive nozzle assembly 12 via a mounting bracket 50 which may preferably be mounted to the abrasive nozzle assembly using one or more fasteners 48. The mounting bracket 50 maintains constant engagement of the focusing nozzle 10 with the vacuum chamber 40.

The fluid 38, for example, water or other cleaning solvents, enters and flows through the fluidic conduit 22 from a pressurized fluid source (not shown), and continues its flow through the shaped jet nozzle 28, and preferably exits the shaped nozzle 28 as a high pressure, cohesive fluidic jet 30 and flows directly into the vacuum chamber 40. A particulate abrasive material 51, such as powdered garnet, sand, and the like, enters the abrasive inlet 44 of the abrasive conduit 42 from a remote source (not shown) as a result of the vacuum created by the flow of the cohesive fluidic jet 30 through the vacuum chamber 40. The abrasive material 51, flows through the abrasive conduit 42, exits the abrasive outlet 46 and enters the vacuum chamber 40 where it is merged into the fluidic jet 30 and forms the mixture of fluid and abrasive particulate material 14, which flows into the focusing nozzle 10.

Figure 3:
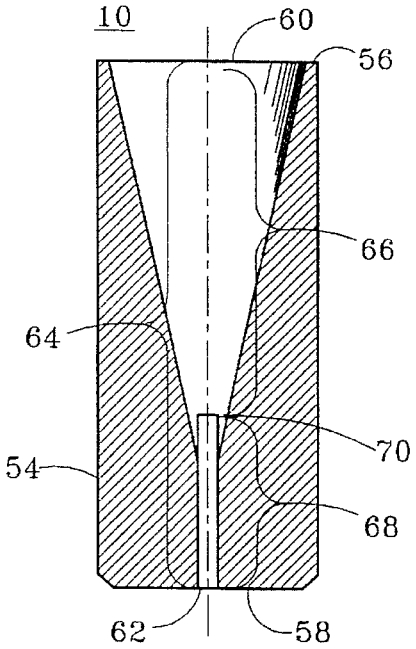
FIG. 3 is a cross-sectional view of the focusing nozzle of the present invention.

With reference to FIG. 3, a cross-section view of the focusing nozzle 10 is illustrated. The focusing nozzle 10 of the present invention includes an elongated, tubular body 54 having a first end 56 and a second end 58, a circular inlet 60 formed at the first end 56 of the elongated body 54 and a non-circular outlet 62, having a smaller diameter than the circular inlet 60, formed at the second end 58 of the elongated body 54. The focusing nozzle 10 additionally includes a central, longitudinal bore 64 retained within the elongated body 54 and disposed between and in contact with the circular inlet 60, and the non-circular outlet 62. The longitudinal bore 64 includes a circular bore portion 66 beginning at the circular inlet 60 and extending toward the non-circular outlet 62 and a non-circular bore portion 68 beginning at the non-circular outlet 62 and extending toward the circular inlet 60. The circular bore portion 66 generally tapers in a narrowing, conical manner beginning at the circular inlet 60 and extending toward but not contacting the non-circular outlet 62. The focusing nozzle 10 includes an intersection 70 within the longitudinal bore 64 where the circular bore portion 66 engages the non-circular bore portion 68.

The unfocused, abrasive-entrained jet 14 flows into the circular inlet 60 of the elongated body 54 of the focusing nozzle 10 wherein the abrasive-entrained jet 14 flows though the circular bore portion 66 and coheres into a narrowing jet as it flows through the non-circular bore portion 68 and out of the non-circular outlet 62. The non-circular bore portion 68 and the non-circular outlet 62 cause the abrasive-entrained jet 14 to exit the focusing nozzle 10 as the sustained, cohesive, focused jet 16, having a prolonged centerline pressure, thus minimizing the focused jet's 16 exposure to air, thereby reducing the degradation of the focused jet 16. The narrowing of the abrasive-entrained jet 14 combined with the cohesive effects of the non-circular bore portion 68 and the non-circular outlet 62, produce the abrasive-entrained, focused jet 16, having a long coherence length and a prolonged centerline pressure to produce clean, precise and sharp-edged kerfs, cuts and grooves 18 in the hard surfaced material 20. The pressure of the abrasive entrained focused jet 16 may be increased, by increasing the pressure of the fluid 38 as it enters the fluidic inlet 24. Increasing the pressure on the fluid 38 entering the fluidic inlet 24, in turn increases the acceleration of the abrasive particulate material 51 as it exits from the non-circular outlet, and results in improved cutting efficiency. Increasing the speed of the abrasive particulate material 51, increases the kinetic energy of the focused jet 16 and correspondingly improves the cutting efficiency of the focused jet 16.

Figure 4A:
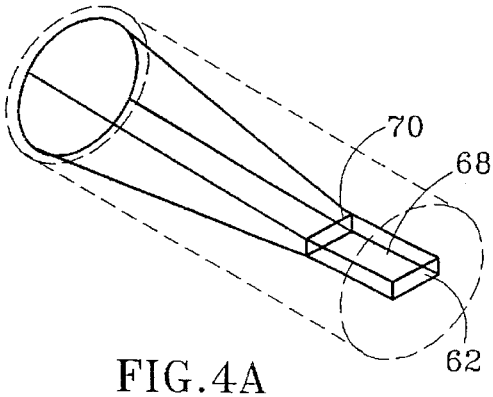
FIG. 4A is a partial cut-away view of the focusing nozzle, illustrating a rectangular shaped non-circular bore portion and non-circular outlet.
Figure 4B:
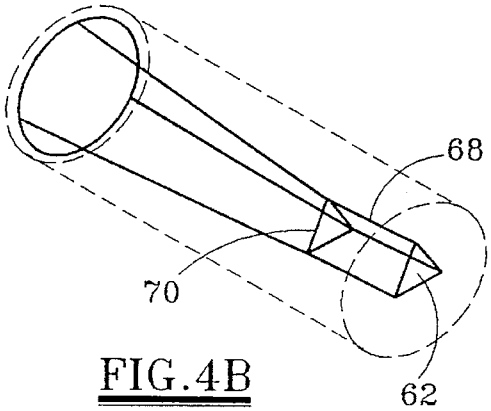
FIG. 4B is a partial cut-away view of the focusing nozzle, illustrating a triangular shaped non-circular bore portion and non-circular outlet.
Figure 4C:
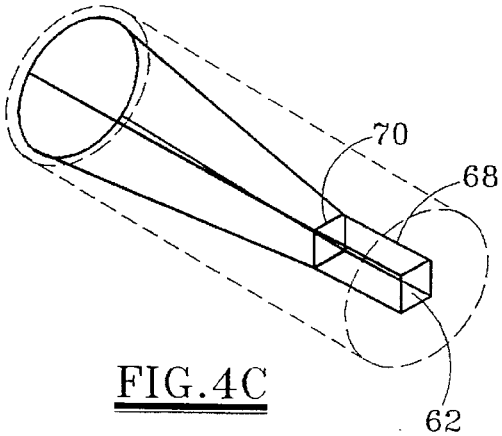
FIG. 4C is a partial cut-away view of the focusing nozzle, illustrating a square shaped non-circular bore portion and non-circular outlet.
Figure 4D:
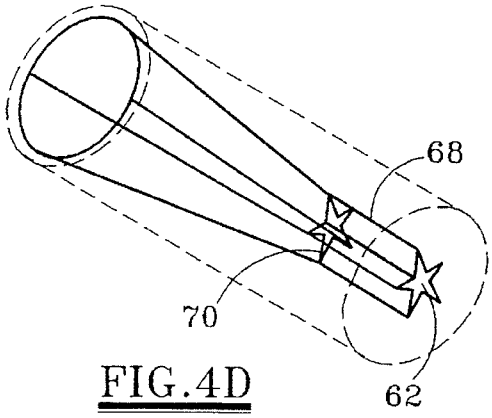
FIG. 4D is a partial cut-away view of the focusing nozzle, illustrating a star shaped non-circular bore portion and non-circular outlet.

With reference to FIGS. 4A, 4B, 4C and 4D the non-circular outlet 62 and the non-circular bore portion 68, may preferably include one of several non-circular shapes. The non-circular bore portion 68 maintains a consistent shape such as, for example, a square, a triangle, a rectangle, or a star depending between and contacting the non-circular outlet 62 and the intersection 70. The shape of the non-circular bore portion 68 is preferably equivalent to the shape of the non-circular outlet 62. FIG. 4A illustrates the non-circular outlet 62 and the non-circular bore portion 68, both having the shape of a rectangle. FIG. 4B illustrates the non-circular outlet 62 and the non-circular bore portion 68, both having the shape of a triangle. FIG. 4C illustrates the non-circular outlet 62 and the non-circular bore portion 68, both having the shape of a square. FIG. 4D illustrates the non-circular outlet 62 and the non-circular bore portion 68, both having the shape of a star. Additional shapes of the non-circular outlet 62 may become apparent, and the above illustrations are not exhaustive.

The focused jet 16, as it exits the non-circular outlet 62 of the focusing nozzle 10, has superior cutting ability and creates clean, highly precise and sharp-edged kerfs, cuts and grooves 18 in hard substances 20 as compared to conventional round abrasive-entrained high pressure jets (not shown). Additionally, the focused jet 16 has a superior coherence length and a prolonged centerline pressure as compared to conventional jets (not shown). The focusing nozzle 10 of the present invention overcomes the previous inability of focusing the jet of a mixture of fluid and abrasive particulate material 14 to produce clean, precise and sharp-edged kerfs 18 in the hard substance 20. Additionally, the focusing nozzle 10 of the present invention produces clean, precise and sharp-edged kerfs 18 in the hard substance 20 using materials 38, 51 having cool to moderate temperatures. Thus the clean, precise and sharp-edged kerfs 18 may be produced in the absence of creating heat, which may adversely affect the hard substance 20. The increased narrowness and speed of the focused jet 16 proportionately increases the depth and precision of kerfs 18. Additionally, the focused jet 16 creates kerfs 18 with uniform and precise edges and kerf 18 walls with little or no taper. The reduced taper in the kerf 18 produced by the focusing nozzle 10 reduces or eliminates the need for reworking materials 20 cut by the focusing nozzle 10. The focused jet 16 creates kerfs 18 without altering the quality or nature of the hard surface 20 in which cuts, grooves and kerfs 18 may be made, unlike heat generated methods of cutting, such as flame cutting and sawing.

The focusing nozzle 10 provides a method of cutting that is safer to the operator (not shown) than heat utilizing methods of cutting. The abrasive nozzle assembly 12, when used with the focusing nozzle 10, can be a farther distance removed from the material 20 to be cut, as compared to conventional round abrasive-entrained high pressure jets (not shown), which must be proximate to a particular surface (not shown). The abrasive nozzle assembly 12, when used with a focusing nozzle 10, can be used selectively with low pressure water jetting systems (not shown) and ultra high pressure water jetting systems (not shown). Further, the focusing nozzle 10 is designed to be adjustably aligned with the shaped jet nozzle 28 while the abrasive nozzle assembly 12 is operating.

The focusing nozzle 10 of the present invention is designed to cut hard surfaces 20 in a manner which is more efficient and cost-effective than known methods of cutting. Further, the easier and safer focusing nozzle 10 alignment reduces setup time. The focusing nozzle 10 can, for some applications, replace complex motion mechanisms (not shown) which employ conventional cutting equipment (not shown). Additionally, the high cutting rate of a focusing nozzle 10 decreases operating costs. Further, the focusing nozzle 10 can be integrated with existing water blasting equipment (not shown), reducing equipment costs.

The foregoing description of the invention is illustrative and explanatory thereof. Various changes in the materials, apparatus, and particular parts employed will occur to those skilled in the art. It is intended that all such variations within the scope and spirit of the appended claims be embraced thereby.

What is claimed is:

1. A focusing nozzle for producing a cohesive focused jet of a mixture of liquid and particulate material, used to make precision cuts in generally hard surfaced materials comprising:

an elongated tubular body having a first end, a second end, a circular inlet formed at the first end of said body and a non-circular outlet formed at the second end of said body, wherein a cohesive jet of liquid and a quantity of particulate material separately enter the circular inlet;

a central, longitudinal bore retained within said elongated body and disposed between and in contact with the circular inlet and the non-circular outlet, said longitudinal bore having a first circular bore portion commencing at the circular inlet and extending toward the non-circular outlet, and a second non-circular bore portion commencing at the non-circular outlet and extending toward the circular inlet, wherein the circular bore portion tapers in a narrowing, conical manner in the direction of the non-circular outlet;

an intersection within said central, longitudinal bore, wherein the first circular bore portion intersects the non-circular bore portion, such that the diameter of the circular bore is a maximum at the circular inlet and a minimum at said intersection; and a non-circular cohesive focused jet of a mixture of liquid and particulate material, egressing from the non-circular outlet formed at the second end of said elongated body, formed from the cohesive let of liquid and the quantity of particulate material entering the circular inlet.

2. The focusing nozzle for producing a high pressure jet of a mixture of liquid and particulate material, as defined in claim 1, wherein the non-circular bore portion, defined by the intersection and the non-circular outlet, remains consistent.

3. The focusing nozzle for producing a cohesive, focused jet of a mixture of liquid and particulate material, as defined in claim 2, wherein the circular bore portion is defined by the circular inlet and the intersection.

4. The focusing nozzle for producing a cohesive, focused jet of a mixture of liquid and particulate material, as defined in claim 3, wherein the non-circular bore comprises a shape defined by the non-circular outlet.

5. The focusing nozzle for producing a cohesive, focused jet of a mixture of liquid and particulate material, as defined in claim 4, wherein the cohesive, focused jet produces a kerf in a hard surface, in the absence of altering the quality and nature of the hard surface.

6. The focusing nozzle for producing a cohesive, focused jet of a mixture of liquid and particulate material, as defined in claim 5, wherein the kerf has generally precise and sharp edges.

7. The focusing nozzle for producing a cohesive, focused jet of a mixture of liquid and particulate material, as defined in claim 6, wherein the speed with which the kerf is created is a function of the velocity of the particulate matter and liquid jetted from the non-circular outlet.

8. The focusing nozzle for producing a cohesive, focused jet of a mixture of liquid and particulate material, as defined in claim 7, wherein the particulate material is comprised of powdered garnet.

9. The focusing nozzle for producing a cohesive, focused jet of a mixture of liquid and particulate material, as defined in claim 8, wherein the non-circular cohesive focused jet of a mixture of liquid and particulate material egressing from the tubular body, has a long coherence length and a slow decaying centerline pressure due to egression from the non-circular outlet.

* * * * *